US007415854B2

(12) United States Patent
Comunello

(10) Patent No.: US 7,415,854 B2
(45) Date of Patent: Aug. 26, 2008

(54) SAFETY LOCK WITH ADJUSTABLE-LENGTH BOLT

(75) Inventor: Vittorio Comunello, Rosa' (IT)

(73) Assignee: Fratelli Comunello S.p.A., Rosa (VI) (IT)

( * ) Notice: Subject to any disclaimer, the term of this patent is extended or adjusted under 35 U.S.C. 154(b) by 154 days.

(21) Appl. No.: 10/504,164

(22) PCT Filed: Dec. 10, 2002

(86) PCT No.: PCT/IT02/00775

§ 371 (c)(1),
(2), (4) Date: May 19, 2005

(87) PCT Pub. No.: WO03/071063

PCT Pub. Date: Aug. 28, 2003

(65) Prior Publication Data

US 2005/0223759 A1 Oct. 13, 2005

(30) Foreign Application Priority Data

Feb. 22, 2002 (IT) ..... PCT/IT02/00107
Feb. 22, 2002 (IT) ..... PCT/IT02/00108

(51) Int. Cl.
*E05B 65/06* (2006.01)

(52) U.S. Cl. ..... 70/134; 70/107; 70/461; 70/152

(58) Field of Classification Search ..... 70/134, 70/107, 461, 150–152
See application file for complete search history.

(56) References Cited

U.S. PATENT DOCUMENTS 215,580 A * 5/1879 Daniels ..... 70/111
313,113 A * 3/1885 Schwerin ..... 70/70
326,673 A * 9/1885 Paciorkowski ..... 70/355
604,652 A * 5/1898 Bust ..... 292/172
857,439 A * 6/1907 Calicchio ..... 70/355
1,098,068 A * 5/1914 Ventrice ..... 70/134
1,274,477 A * 8/1918 Warne ..... 70/150

(Continued)

FOREIGN PATENT DOCUMENTS

DE 338464 * 6/1921

(Continued)

*Primary Examiner*—Suzanne D Barrett
(74) *Attorney, Agent, or Firm*—Browdy and Neimark

(57) ABSTRACT

Safety lock for doors, gates or the like, comprising a box-shaped body (2) which contains and supports a bolt (5) able to slide between several operating positions (9, 10), actuating means (8) for displacing the bolt (5) between the above-mentioned position, a movable plate (15) capable of engaging by means of engaging means (17) inside seats (14) formed along the bolt (5) so as to retain it in the above-mentioned retracted and projecting positions. The lock (1) also has adjustment means (20) which are accessible from the outside of the box-shaped body (2) and are able to act on the movable plate (15) so as to engage it/disengage it with respect to the bolt (5) so as to allow the latter to be arranged with the part (5*a*) projecting by the desired length. The movable plate (15) is mounted rotatably on the box-shaped body (2) about an axis of rotation (Z) by means of a pin (19); with respect to which it is able to rotate as a result of the action of adjustment means (20).

15 Claims, 8 Drawing Sheets

U.S. PATENT DOCUMENTS

| | | | | |
|---|---|---|---|---|
| 1,502,318 | A * | 7/1924 | Raconovich | 70/134 |
| 6,684,669 | B1 * | 2/2004 | Talpe | 70/107 |
| 7,104,096 | B2 * | 9/2006 | Comunello | 70/107 |

FOREIGN PATENT DOCUMENTS

| | | | |
|---|---|---|---|
| DE | 418 353 | C | 9/1925 |
| DE | 485 632 | C | 11/1929 |
| DE | 2526217 | * | 12/1976 |
| FR | 2691497 | * | 11/1993 |
| FR | 2783271 | * | 3/2000 |
| WO | WO 98 37295 | A | 8/1998 |

* cited by examiner

SAFETY LOCK WITH ADJUSTABLE-LENGTH BOLT

The present invention relates to a safety lock with an adjustable-length bolt.

More particularly, the lock in question is intended to be advantageously mounted on doors, main entrances, gates or the like so as to perform closing thereof against a fixed frame of a casing.

These locks are generally composed, as is known, of a box-shaped body normally made of metallic material and intended to form the structure for supporting and containing the locks, inside which the bolt movement mechanisms are housed. The latter can normally be operated from the outside on one side or both sides of the door by means of a key performing one or more turns.

The box-shaped body is fixed in a seat provided inside a special recess in the door, normally by means of screws, and has a front plate provided with a through-hole for receiving the bolt.

In greater detail, the bolt is able to slide inside the through-hole between a retracted position, where it is partially (or totally) housed inside the box-shaped body, and a projecting position, where it extends outside the front plate so as to engage inside a corresponding seat provided inside the upright.

As is known, it is possible to envisage that the bolt may extend from the front plate with its extending portion by a variable amount depending on the specific applicational requirements. The latter may include the need to ensure a greater or smaller penetration of the bolt into the seat of the frame or may depend on the specific constructional forms of the door or gate on which the lock must be mounted, which, as is known, in certain cases may require the use of longer or shorter bolts.

In any case, it is clearly of use, in the sector concerned, to be able to vary the length of the bolt depending on specific applicational requirements.

In order to meet this need, locks provided with adjustment means able to vary the length of the bolt portion which extends outside the housing box have been developed.

These solutions, however, have proved to be impractical in that the box-shaped body must first be opened in order to operate the adjustment means and therefore vary the length of the projecting portion by the desired amount.

Moreover, numerous systems able to vary the projecting portion of a latch mounted inside the said box-shaped body and mechanically connected to a handle and/or to the said bolt movement mechanisms are already known.

These systems may very often be operated directly from the outside and are therefore particularly convenient. It must however be pointed out that the possibility of performing an adjustment of the projecting portion of the latch is facilitated by the fact that the actuating mechanism to which the latch is connected is simpler and different compared to that to which the bolt is connected.

Some solutions involving latches which can be adjusted from the outside of the box-shaped body are described and illustrated for example in the patents of industrial invention FR 2,783,271, EP 712987 and EP 963498.

The main object of the present invention is therefore that of overcoming the drawbacks of the solutions of the known type mentioned above, by providing a safety lock with an adjustable-length bolt which is constructionally simple and inexpensive to manufacture and operationally entirely reliable.

A further object of the present invention is that of providing a lock which allows the adjustment of the projecting portion of the bolt without having to extract the lock from its housing and by exclusively operating on the outside of the box-shaped body containing the lock.

A further object of the present invention is that of providing a lock, the components of which are easy to manufacture by means of simple mechanical machining processes.

These objects, together with others, are all achieved by the safety lock according to the present invention, which comprises: a box-shaped body defined by at least one support base and by a front plate; a bolt mounted slidably on the box-shaped body in the direction of its longitudinal axis; actuating means able to move the bolt in the longitudinal direction between different operating positions; a movable element provided with engaging means intended to engage in seats provided along the bolt so as to retain the latter in the operating positions.

According to the invention, the lock is characterized in that it comprises adjustment means which are accessible from the outside of the box-shaped body and are able to actuate the movable element producing a displacement thereof having at least one rotary component so as to engage/disengage the engaging means in/from the seats.

The technical features of the invention, in accordance with the abovementioned objects, may be determined from the contents of the claims reproduced below and the advantages thereof will emerge more clearly from the following detailed description, with reference to the accompanying drawings, which show some purely exemplary and non-limiting embodiments, wherein:

Figure 8B:
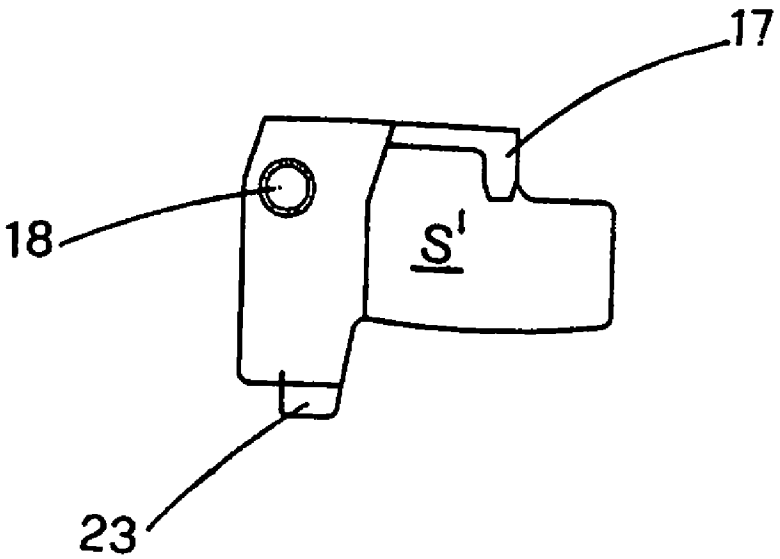
Figure 8A:
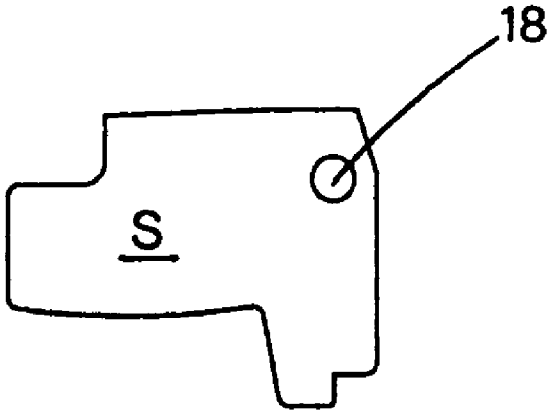

FIGS. 8*a* and 8*b* show two plan views, from two opposite sides, of the movable plate.

In accordance with the figures of the accompanying drawings, 1 denotes overall the lock according to the present invention.

Said lock is suitable for mounting on doors, gates or the like so as to close the latter against a fixed frame, for example consisting of an upright of a casing, not shown in the accompanying drawings because of a type known per se.

The lock comprises traditionally a box-shaped body 2 made of rigid—generally metallic—material and having a support base 3 from which a front plate 4 extends perpendicularly.

Figure 1:
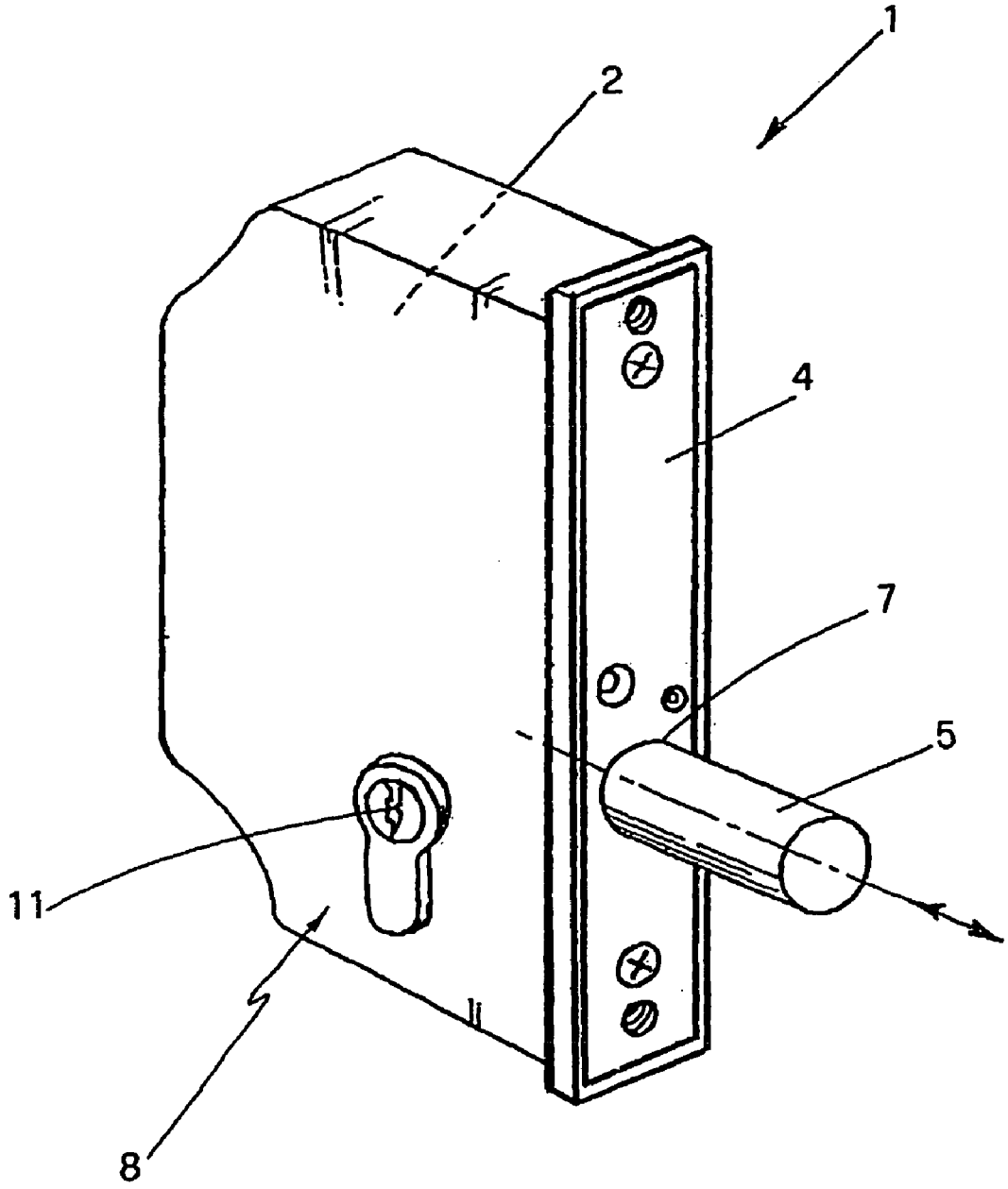
FIG. 1 shows schematically an overall perspective view of an example of a lock according to the invention.
Figure 2:
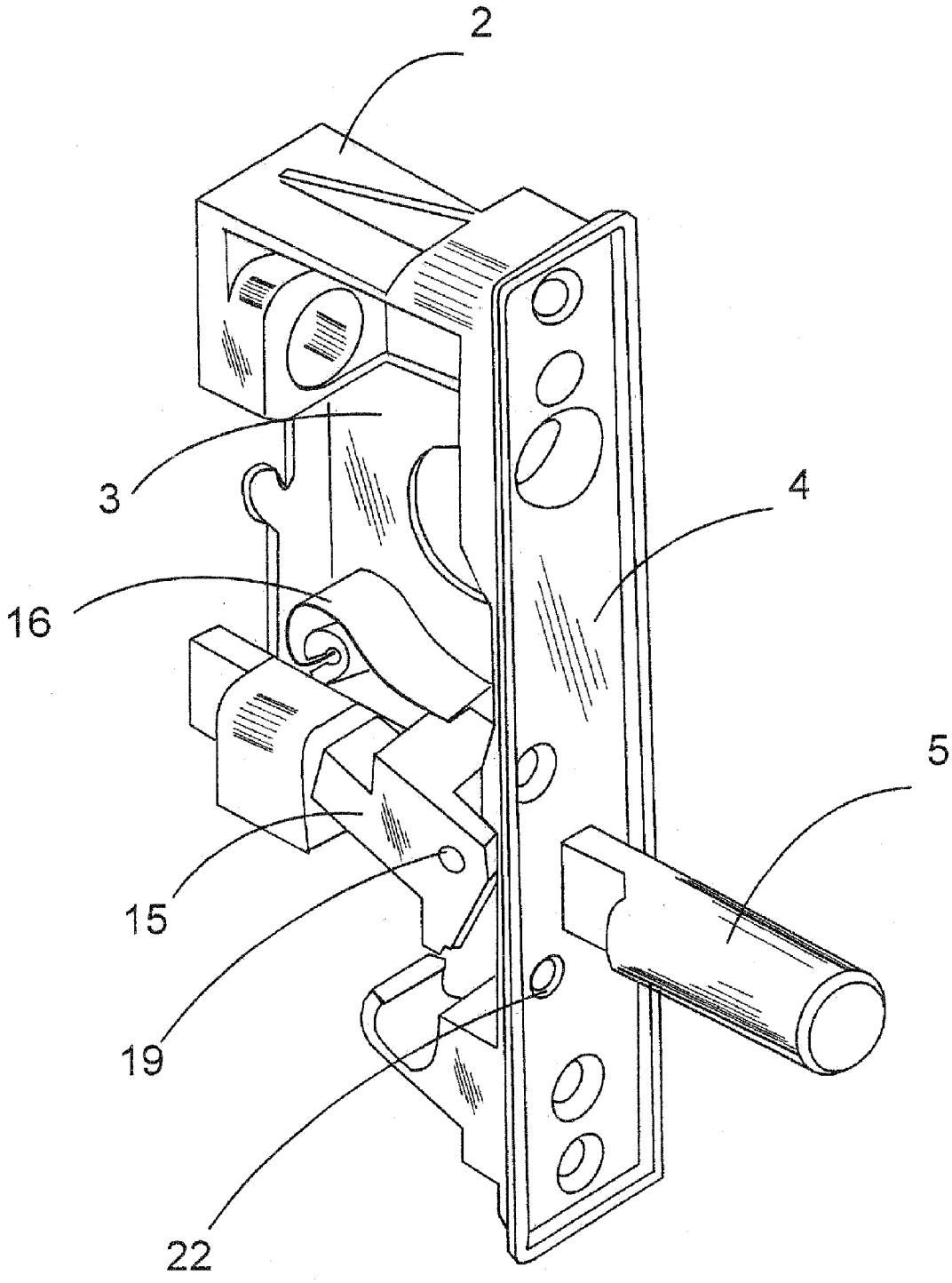
FIG. 2 shows a further example of a lock according to the invention with some parts removed so that other parts may be seen more clearly.
Figure 3:
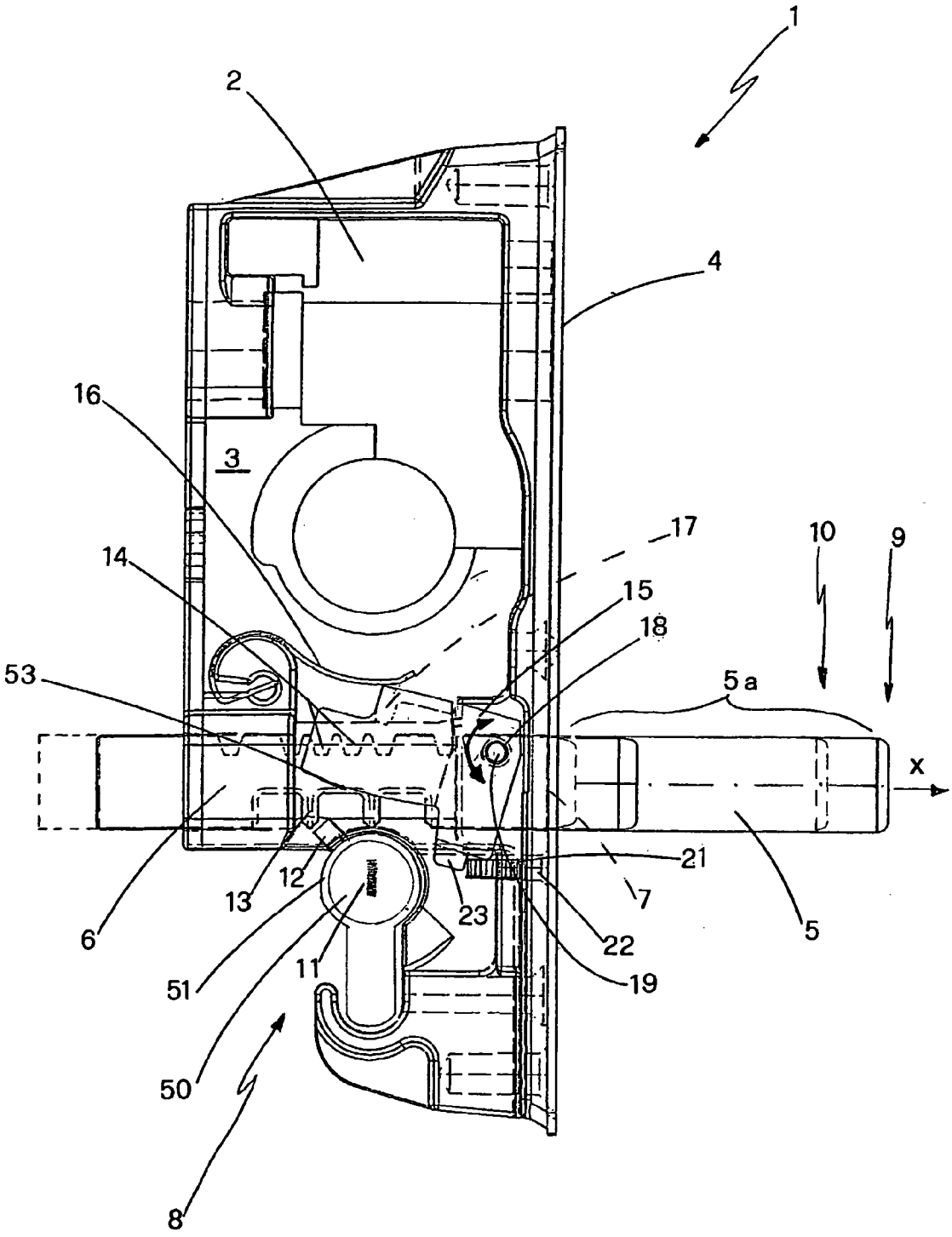
FIG. 3 shows a front view of the lock according to FIG. 2 with key-type actuating means inserted.
Figure 4:
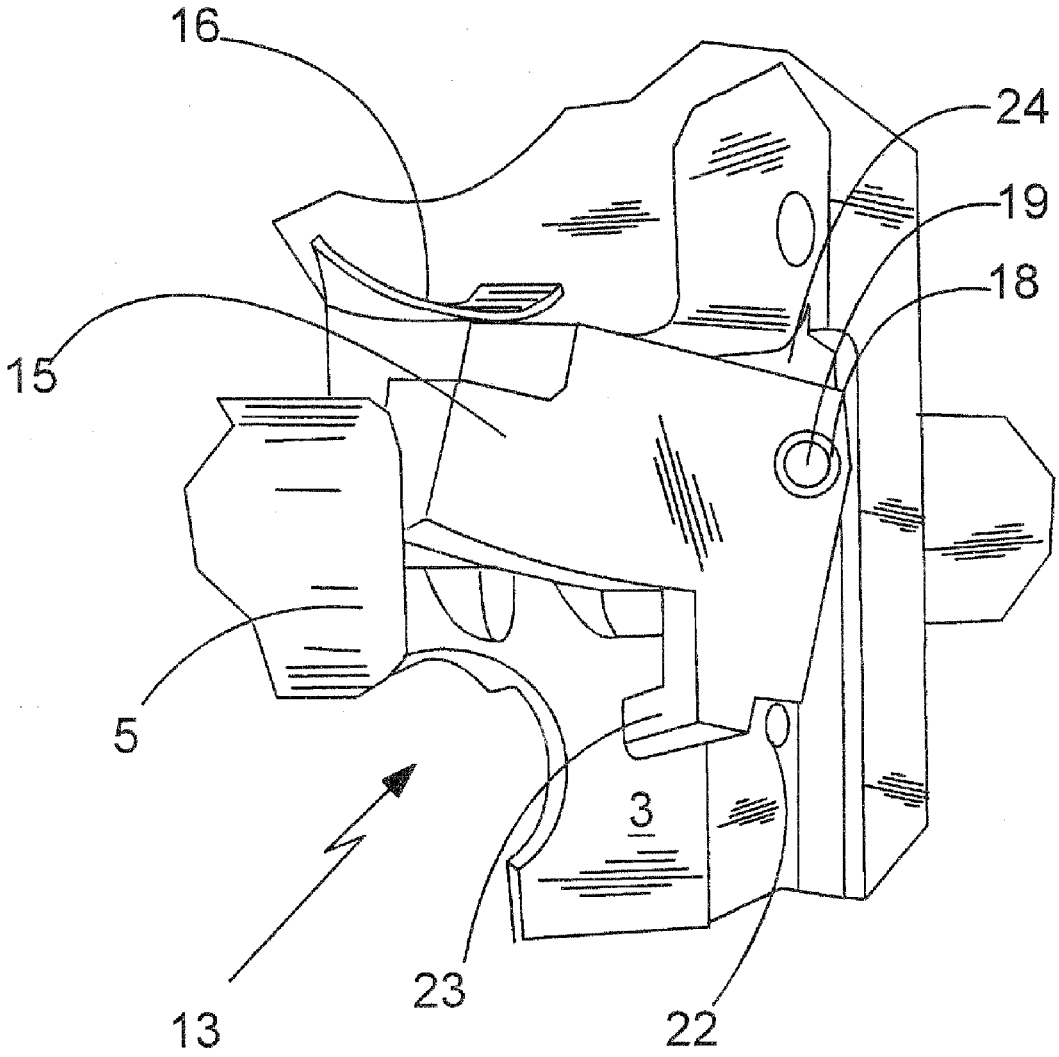
FIG. 4 shows a perspective view of an enlarged detail of the lock according to FIG. 2.

In accordance with the embodiment shown in detail in the accompanying FIGS. 2 and 3, the said box-shaped body 2 is intended to support also a handle, arranged on one side or on both sides of the box-shaped body 2, or also a latch which can be actuated preferably by means of the said handle.

The lock 1 also comprises a bolt 5 mounted slidably on the box-shaped body 2 by means of a support guide 6 and a shaped hole 7 formed on the front plate 4.

During use, the bolt 5 is displaced by means of actuating means 8 between one or more operating positions including generally one or more projecting positions 9 (depending on the number of turns imparted by the actuating means) and a retracted position 10. In this way, it is engaged with and disengaged from a corresponding matching seat formed in the fixed frame, so as to perform the secure closure of a door or a gate against the said frame or so as to release the said door or the said gate, allowing opening thereof.

As will be clarified below, according to the present invention, the bolt may vary its position also as a result of a different adjustment which will cause it to extend from the front plate 4 with a longer or shorter portion 5*a*.

When the bolt 5 is arranged in the retracted position 10, it may nevertheless advantageously extend outside the front plate 4 with a projecting portion 5*a*, as indicated in particular in the example according to FIG. 2.

Alternatively, in accordance with a possible embodiment not shown in detail, the bolt 5 may disappear completely inside the box-shaped body 2 when it is located in the retracted position 10 and during a particular adjustment condition.

The abovementioned actuating means 8 are of a type conventional per se and are for example formed in accordance with the example contained in the accompanying figures by a cylinder-type actuator provided with a keyhole 11 for insertion of a key not shown. The latter, rotating in the keyhole 11, causes rotation of a cylindrical block 50 inside a lining drum 51. The block 50 is provided with an associated projection 12 able to engage inside a set of teeth 13 formed by means of incisions along the bottom part of the bolt 5 so as to cause axial sliding thereof along its longitudinal axis X.

The upper part of the said bolt 5 similarly has, formed in it, a plurality of seats 14 also arranged in sequence in the manner of the teeth 13 arranged along the longitudinal extension of the bolt 5.

Figure 6:
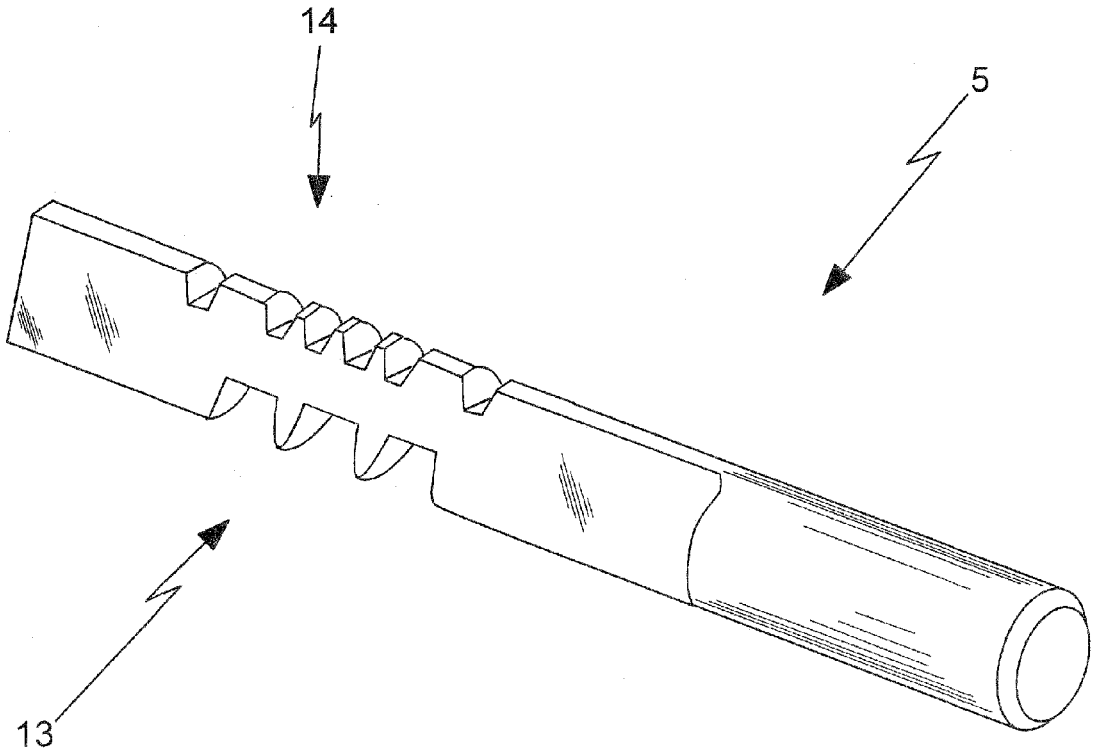

FIG. 6 shows in detail a preferred embodiment of the bolt 5.

A movable element 15 having a plate-like form, referred to below as movable plate 15, is especially provided in order to keep the bolt 5 in the projecting position 10 and retracted position 9 which it assumes as a result of the action of the actuating means 8, or simply following rotation of the key through one or more turns in the direction in which this is permitted.

During operation, the movable plate 15 is biased against the bolt by the action of resiliently yielding means 16 and is provided with engaging means 17 which are normally engaged in a retained relationship inside the abovementioned seats 14 of the bolt 8.

Figure 7:
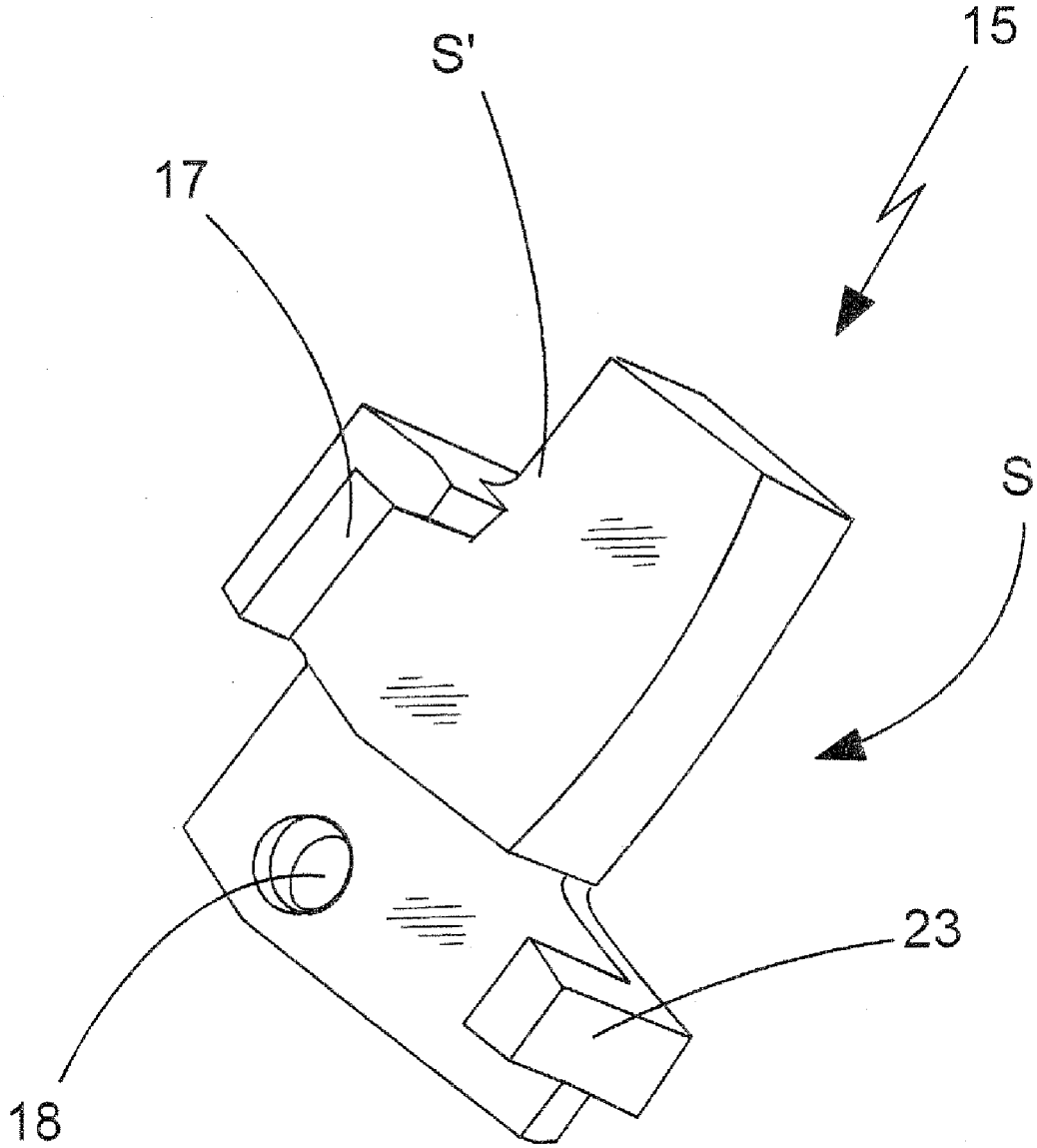

Advantageously, the engaging means 17 may simply be formed by a tooth integral with the plate 15, as shown in FIG. 7.

The abovementioned resiliently yielding means 16 are advantageously formed by a flexible metal leaf which is secured at one of its ends to a special seat in the box-shaped body 2 and rests, under compression, with its other end against the upper part of the movable plate 15.

In greater detail, the movable plate 15 is substantially formed by a thin—preferably metallic—element arranged so as to lie parallel to the support base 3 of the box-shaped body 2 and defined by two sides S, S' substantially parallel to each other and to said surface, a first one S of which being substantially flat and a second one S' of which having the engaging tooth 17 projecting perpendicularly with respect to its plane of lie.

Obviously, the movable element 15 may also assume other configurations which are different from the preferential plate-shaped form described above, but which nevertheless fall within the scope of the said inventive idea of this patent.

For the sake of constructional simplicity, the movable plate 15 is arranged on the outside of the bolt 5 with respect to the support base 3 of the box-shaped body 2.

The movable plate 15 is also provided with a hole 18, preferably of the through-type, which is perpendicular to the two sides S, S' and is capable of receiving a pin 19 with an axis of rotation Z perpendicular to the support base 3. The pin is fixed to the box-shaped body 2 and mechanically connects the plate 15 to the said box-shaped body 2.

Figure 5:
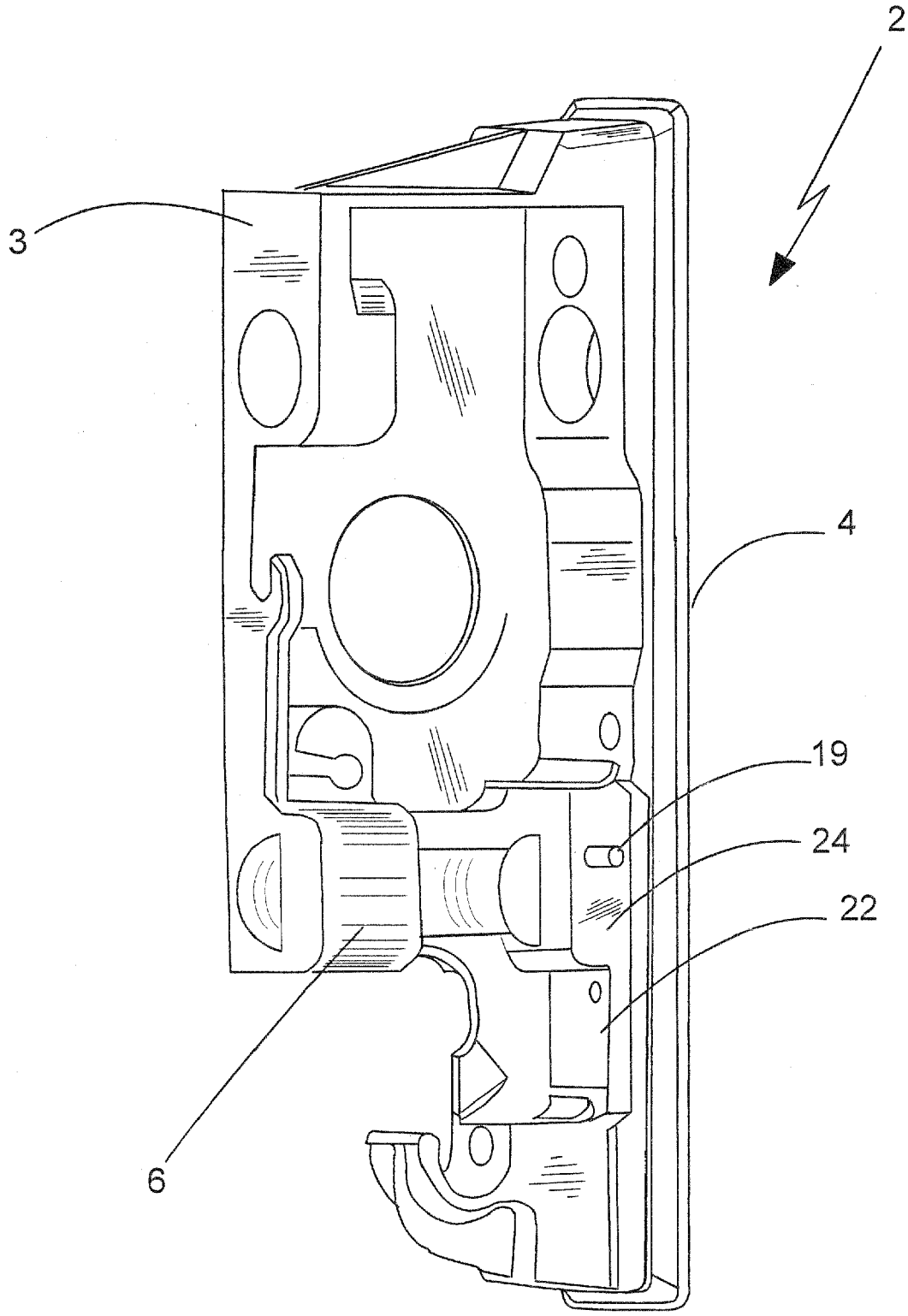
FIGS. 5, 6 and 7 show three enlarged details of the lock according to FIG. 2, relating respectively to a box-shaped body, to a bolt and to a movable plate.

The pin 19 forms, in accordance with the example illustrated in the accompanying figures, one piece with the box-shaped body 2 and is provided on a plinth 24 which projects upwards from the support base 3 in the vicinity of the front plate 4, as can be clearly seen in FIG. 5.

Alternatively, in accordance with a further embodiment not shown in detail in the accompanying figures, it is possible to envisage instead that the pin 19 is instead integral with the movable plate 15 and extends perpendicularly from its second side S' so as to engage in a corresponding hole formed in the box-shaped body 2.

In any case, as a result of this mode of constraint, the plate 15 is substantially free to rotate on the box-shaped body 2, as indicated by the arrow F in FIG. 3 and not to slide thereon. This rotation is however opposed by the compressive action exerted by the leaf 16, which tends to bias the movable plate 15 against the bolt 5, so that the engaging means 17 are constrained inside the seats 14.

In accordance with a different embodiment of the present invention, the movable plate 15 may perform rotary/translational movements or more generally have at least one rotary component and one component of displacement.

During operation, the actuating means 8 engage, by means of the projection 12, with the teeth 13 so as to displace the bolt 5 in the direction of its axis X, and at the same time the actuating means 8 also release the bolt 5 from engagement with the movable plate 15 so as to allow displacement thereof.

In fact, the projection 12, during its rotation produced by the key, interferes with the bottom profile 53 of the movable plate and, overcoming the opposing action of the leaf 16, is able to cause rotation of the movable plate 15 about the pin 19 and therefore raising of the engaging teeth 17 from the seats 14.

According to a main characteristic feature of the present invention, the lock 1 comprises adjustment means which are accessible from the outside of the box-shaped body 2 and act on the movable plate 15, imparting to it a rotation so as to engage/disengage the engaging element in/from the seats 14.

During operation, by operating the adjustment means, it is possible to overcome the resilient opposing action of the leaf 16 and cause rotation of the movable plate 15 by the amount needed to free the bolt 5 from engagement therewith. The latter, once freed, is able to slide in the longitudinal direction of its axis X so as to allow it to be positioned with the projecting portion 5*a* extending from the front plate 4 by the desired length, which, as mentioned, will generally depend on specific applicational requirements.

The adjustment means may in general impart to the movable plate 15 displacements having at least one rotary component.

In accordance with the example shown in FIG. 6, three different adjustment positions are possible.

The adjustment means may be preferably formed by an adjusting screw 21 inserted inside a threaded through-hole 22 formed on the front plate 4 of the box-shaped body 2 and intended to bear against a shaped portion 23 of the movable plate 15.

In the case of the example shown in FIG. 7, the shaped portion 23 is formed by a lug extending perpendicularly from the second side S' of the movable plate 15.

As a result of the invention in question it is possible to adjust in a simple and practical manner the length of the portion 5*a* of the bolt 5 which extends outside of the front plate 4 of the lock 1.

In fact, in order to perform the abovementioned adjustment, it is sufficient for a user to operate the screw 21, for example simply using a screw driver, causing the screw 21 itself to advance in its screwing direction until it bears first against the shaped portion 23 of the movable plate 15 and then until the movable plate 15 is rotated, disengaging the bolt 5.

At this point, the user may cause sliding of the bolt 5 inside the guides 6, 7 until the desired position is reached, with the projecting portion 5*a* extending by a desired amount.

Finally, the user operates the screw 21 again, unscrewing it until the movable plate 15 is made to engage again in the seats 14 of the bolt 5.

A further advantage of the present invention relates to the particular arrangement assumed by the movable plate 15, on the outside of the bolt 5, which allows simplified assembly of the lock 1 and easier maintenance.

Owing to the rotational instead of the sliding movement performed by the plate 15, it is possible to provide a particularly simple operating mechanism which results in a considerable saving in the costs of production of the lock.

The invention claimed is:

1. Safety lock with adjustable-length bolt, in particular for doors or gates, comprising:

a box-shaped body (2) defined by at least one support base (3) and by a front plate (4);

at least one bolt (5) having a longitudinal axis and mounted slidably on said box-shaped body (2) in the direction of said longitudinal axis (X);

actuating means (8) able to move said bolt (5) in said direction of said longitudinal axis (X) between different operating positions;

at least one movable element (15) provided with engaging means (17) intended to engage in seats (14) provided along said bolt (5) so as to retain the latter in said operating positions, said movable element being movable in response to said actuating means;

wherein said safety lock further comprises adjustment means operable independently of said actuating means, said adjustment means being accessible from the outside of said box-shaped body (2) and being able to actuate said movable element (15) producing a displacement of said movable element, said movable element having at least one rotary component so as to engage and/or disengage said engaging means (17) in/from said seats (14).

2. Safety lock according to claim 1, wherein said movable element is rotatably connected to said box-shaped body (2) about an axis of rotation (Z) with respect to which said movable element is able to rotate as a result of the action of said adjustment means.

3. Safety lock with adjustable-length bolt, in particular for doors or gates, comprising:

a box-shaped body (2) defined by at least one support base (3) and by a front plate (4);

at least one bolt (5) having a longitudinal axis and mounted slidably on said box-shaped body (2) in the direction of said longitudinal axis (X);

actuating means (8) able to move said bolt (5) in said direction of said longitudinal axis (X) between different operating positions;

at least one movable element (15) provided with engaging means (17) intended to engage in seats (14) provided along said bolt (5) so as to retain the latter in said operating positions;

wherein said safety lock further comprises adjustment means operable independently of said actuating means, said adjustment means being accessible from the outside of said box shaped body (2) and being able to actuate said movable element (15) producing a displacement or said adjustment means having at least one rotary component so as to engage and/or disengage said engaging means (17) in/from said seats (14), wherein said adjustment means comprise at least one adjusting screw (21) inserted in a through-hole (22) formed in said box-shaped body (2), accessible from the outside of said box-shaped body (2) and able to bear against said movable element (15).

4. Safety lock according to claim 3, wherein said through-hole (22) is formed on said front plate (4).

5. Safety lock according to claim 3, wherein said through-hole (22) is threaded.

6. Safety lock according to claim 1, wherein said bolt is arranged between said movable element (15) and said support base (3) of said box-shaped body (2).

7. Safety lock according to claim 1, wherein said movable element (15) is mechanically connected to said box-shaped body (2) by means of a pin (19) defining an axis of rotation (Z).

8. Safety lock with adjustable-length bolt, in particular for doors or gates, comprising:

a box-shaped body (2) defined by at least one support base (3) and by a front plate (4);

at least one bolt (5) having a longitudinal axis and mounted slidably on said box-shared body (2) in the direction of said longitudinal axis (X);

actuating means (8) able to move said bolt (5) in said direction of said longitudinal axis (X) between different operating positions;

at least one movable element (15) provided with engaging means (17) intended to engage in seats (14) provided along said bolt (5) so as to retain the latter in said operation positions;

wherein said safety lock further comprises adjustment means operable independently of said actuating means, said adjustment means being accessible from the outside of said box-shaped body (2) and being able to actuate said movable element (15) producing a displacement or said adjustment means having at least one rotary component so as to engage and/or disengage said engaging means (17) in/from said seats (14), wherein said pin (19) is provided on a plinth (24) which projects upwards from the support base (3) of said box-shaped body (2) in the vicinity of said front plate (4) and engages in a hole (18) formed in said movable element (15).

9. Safety lock according to claim 7, wherein said pin (19) forms one piece with said box-shaped body (2).

10. Safety lock according to claim 1, wherein said front plate (4) is provided with a shaped hole (7) for receiving in a guided manner said bolt (5).

11. Safety lock with adjustable-length bolt, in particular for doors or gates, comprising:

a box-shaped body (2) defined by at least one support base (3) and by a front plate (4);

at least one bolt (5) having a longitudinal axis and mounted slidably on said box-shaped body (2) in the direction of said longitudinal axis (X);

actuating means (8) able to move said bolt (5) in said direction of said longitudinal axis (X) between different operating positions;

at least one movable element (15) provided with engaging means (17) intended to engage in seats (14) provided along said bolt (5) so as to retain the latter in said operating positions;

wherein said safety lock further comprises adjustment means operable independently at said actuating means, said adjustment means being accessible from the outside of said box-shaped body (2) and being able to actuate said movable element (15) producing a displacement of said adjustment means having at least one rotary component so as to engage and/or disengage said engaging means (17) in/from said seats (14), wherein said safety lock further comprises resiliently yielding means (16) able to push said movable element (15) against said bolt (5) in order to keep said engaging means (17) normally engaged in said seats (14).

12. Safety lock according to claim 11, wherein said resiliently yielding means (16) comprise at least one flexible leaf having a first end that is secured to said box-shaped body (2) and having a second end that bears, under compression, substantially against said movable element (15).

13. Safety lock with adjustable-length bolt, in particular for doors or gates, comprising:

a box-shaped body (2) defined by at least one support base (3) and by a front plate 4);

at least one bolt (5) having a longitudinal axis and mounted slidably on said box-shared body (2) in the direction of said longitudinal axis (X);

actuating means (8) able to move said bolt (5) in said direction of said longitudinal axis (X) between different operating positions;

at least one movable element (15) provided with engaging means (17) intended to engage in seats (14) provided along said bolt (5) so as to retain the latter in said operating positions;

wherein said safety lock further comprises adjustment means operable independently of said actuating means, said adjustment means being accessible from the outside of said box-shaped body (2) and being able to actuate said movable element (15) producing a displacement or said adjustment means having at least one rotary component so as to engage and/or disengage said engaging means (17) in/from said seats (14), wherein said engaging means (17) consist of a tooth extending perpendicularly with respect to the plane of lie of said movable element (15).

14. Safety lock according to claim 1, wherein said movable element (15) is provided with a shaped portion (23) intended to receive, in engagement, said adjustment means.

15. Safety lock according to claim 1, wherein said seats (14) are formed by a plurality of incisions aligned along the longitudinal axis (X) of said bolt (5).

* * * * *